US009577321B2

(12) United States Patent
Wang et al.

(10) Patent No.: US 9,577,321 B2
(45) Date of Patent: Feb. 21, 2017

(54) DUALBAND ANTENNA WITH ISOLATION ENHANCED AND METHOD THEREOF

(71) Applicant: REALTEK SEMICONDUCTOR CORP., Hsinchu (TW)

(72) Inventors: Sy Been Wang, Chu Pei (TW); Ching Wei Ling, Chu Pei (TW); Chih Pao Lin, Chu Pei (TW)

(73) Assignee: REALTEK SEMICONDUCTOR CORP, Hsinchu (TW)

( * ) Notice: Subject to any disclaimer, the term of this patent is extended or adjusted under 35 U.S.C. 154(b) by 70 days.

(21) Appl. No.: 14/724,199

(22) Filed: May 28, 2015

(65) Prior Publication Data

US 2016/0190700 A1 Jun. 30, 2016

(30) Foreign Application Priority Data

Dec. 26, 2014 (TW) ..... 103145730 A

(51) Int. Cl.

| | |
|---|---|
| ***H01Q 1/38*** | (2006.01) |
| ***H01Q 1/52*** | (2006.01) |
| ***H01Q 9/42*** | (2006.01) |
| ***H01Q 5/371*** | (2015.01) |

(52) U.S. Cl.

CPC ..... *H01Q 1/38* (2013.01); *H01Q 1/521* (2013.01); *H01Q 5/371* (2015.01); *H01Q 9/42* (2013.01)

(58) Field of Classification Search

CPC ..... H01Q 1/38; H01Q 5/371; H01Q 1/521; H01Q 9/42

USPC ..... 343/700 MS

See application file for complete search history.

(56) References Cited

U.S. PATENT DOCUMENTS

| | | | | |
|---|---|---|---|---|
| 8,203,489 | B2 * | 6/2012 | Li | H01Q 1/243 343/700 MS |
| 8,269,676 | B2 * | 9/2012 | Lin | H01Q 1/243 343/700 MS |
| 8,390,519 | B2 * | 3/2013 | Wang | H01Q 1/243 343/700 MS |
| 8,958,845 | B2 * | 2/2015 | Alexopoulos | H01Q 1/521 455/550.1 |

FOREIGN PATENT DOCUMENTS

| | | |
|---|---|---|
| TW | M343258 U | 10/2008 |
| TW | I323528 B | 4/2010 |

* cited by examiner

*Primary Examiner* — Brian Young

(74) *Attorney, Agent, or Firm* — Muncy, Geissler, Olds & Lowe PC

(57) ABSTRACT

An antenna set includes a first antenna, a second antenna, and a neutralized line. Each of the first antenna and the second antenna has a low frequency resonant path and a high frequency resonant path. The neutralized line is couple to the low frequency resonant path of the first antenna and the low frequency resonant path of the second antenna. The low frequency resonant path of the first antenna and the low frequency resonant path of the second antenna correspond to a first frequency band, the high frequency resonant path of the first antenna and the high frequency resonant path of the second antenna correspond to a second frequency band, and the two low frequency resonant paths do not overlap the two high frequency resonant paths.

12 Claims, 8 Drawing Sheets

DUALBAND ANTENNA WITH ISOLATION ENHANCED AND METHOD THEREOF

This application claims the benefit of the filing date of Taiwan Application Ser. No. 103145730, filed on Dec. 26, 2014, the content of which is incorporated herein by reference.

BACKGROUND OF THE INVENTION a. Field of the Invention

The invention relates to an antenna set and an isolation enhancement method for use with different systems having dual-band antennas, where the dual-band antennas achieve high isolation when the different systems operate in an identical frequency band.

b. Description of the Related Art

An antenna is a key component for wireless communications systems. Because significant progress has been made on multiple entry/exit systems and integrated access devices, the number of antennas provided for a single apparatus is increased by several times to result in antenna coupling effects and thus reduce radiation efficiency. Besides, signal interference among different antenna systems may occur, and the signal interference is particularly severe when different antenna systems operate in an identical frequency band. Accordingly, it is desirable to design an antenna system confined in a limited space to have high radiation efficiency and isolation, which is the main subject of the invention.

In conventional wireless communications systems, communication bands of 2.4 GHz-2.5 GHz and 5.15 GHz-5.85 GHz are reserved for a wireless communication protocol 802.11ac for faster communications; however, these communication bands are open, and the communication band of 2.4 GHz-2.5 GHz is also available to other wireless communication interfaces such as blue tooth, cell phone, etc.

As illustrated in FIG. 1, a conventional dual-band antenna set 100 includes a first dual-band antenna 101 and a second dual-band antenna 102 that are the same in structure and characteristic.

In case the right-side second dual-band antenna 102 serves as a excitation source, an induced electric field may be formed to influence the left-side first dual-band antenna 101. Note since a low-frequency band of 2.4-2.5 GHz is in open use, the first dual-band antenna 101 is influenced by resonance effects induced by the second dual-band antenna 102 when the antennas 101 and 102 operate in an identical frequency band. The distribution of dense hatched areas illustrated in FIG. 1 indicates low-frequency signal interference is more significant when the antennas 101 and 102 operate in an identical frequency band.

Because the separation provided by passive elements such as filters fails to resolve the signal interference occurs in an identical frequency band, the amount of coupling between antennas is reduced to decrease the signal interference caused by other system operating in the same frequency band. Accordingly, it is highly desirable to provide an antenna system with high antenna isolation and improved radiation efficiency.

BRIEF SUMMARY OF THE INVENTION

An object of the invention is to provide a dual-band antenna set for a multiple entry/exit system. The dual-band antenna set has a neutralized line and/or a slot used to enhance antenna isolation.

According to an embodiment of the invention, an antenna set includes a first antenna, a second antenna, and a neutralized line. Each of the first antenna and the second antenna has a low frequency resonant path and a high frequency resonant path. The neutralized line is couple to the low frequency resonant path of the first antenna and the low frequency resonant path of the second antenna. The low frequency resonant path of the first antenna and the low frequency resonant path of the second antenna correspond to a first frequency band, the high frequency resonant path of the first antenna and the high frequency resonant path of the second antenna correspond to a second frequency band, the two low frequency resonant paths do not overlap the two high frequency resonant paths, and, when the antenna set operates in the first frequency band, the neutralized line adjusts a current flowing through the two low frequency resonant paths to reduce coupling effects between the two low frequency resonant paths.

According to another embodiment of the invention, an antenna set includes a first antenna, a second antenna, and a neutralized line. The first antenna comprises a first low frequency antenna and a first high frequency antenna, the first low frequency antenna has a first low frequency resonant path, and the first high frequency antenna having a first high frequency resonant path. The second antenna includes a second low frequency antenna and a second high frequency antenna, the second low frequency antenna has a second low frequency resonant path, and the second high frequency antenna has a second high frequency resonant path. The neutralized line is coupled to the first low frequency antenna and the second low frequency antenna to form a connection path. A reference ground with a slot is formed on a substrate. The reference ground is coupled to the first antenna and the second antenna, and the slot separates low-frequency electric fields induced by the two low frequency resonant paths. The connection path is coupled to the first low frequency resonant path and the second low frequency resonant path to divide a current flowing through the first low frequency resonant path and the second low frequency resonant path and thus reduce coupling effects between the first low frequency antenna and the second low frequency antenna.

According to another embodiment of the invention, an isolation enhancement method of an antenna set includes the following steps. First, a first antenna and a second antenna are provided, where each of the first antenna and the second antenna has a low frequency resonant path and a high frequency resonant path. A neutralized line is coupled to the low frequency resonant path of the first antenna and the low frequency resonant path of the second antenna. A reference ground with a slot is formed on a substrate. The reference ground is coupled to the first antenna and the second antenna, and the slot separates low-frequency electric fields induced by the two low frequency resonant paths. Further, the two low frequency resonant paths are set to correspond to a first frequency band, and the two high frequency resonant paths are set to correspond to a second frequency band, and the two low frequency resonant paths do not overlap the two high frequency resonant paths. When the antenna set operates in the first frequency band, the neutralized line adjusts a current flowing through the two low frequency resonant paths to reduce coupling effects between the two low frequency resonant paths.

According to the above embodiments, the neutralized line and/or the slot are used to enhance the antenna isolation to reduce signal interference with respect to the same frequency band and thus resolve problems of conventional designs.

Other objectives, features and advantages of the invention will be further understood from the further technological features disclosed by the embodiments of the invention wherein there are shown and described preferred embodiments of this invention, simply by way of illustration of modes best suited to carry out the invention.

DETAILED DESCRIPTION OF THE INVENTION

In the following detailed description of the preferred embodiments, reference is made to the accompanying drawings which form a part hereof, and in which are shown by way of illustration specific embodiments in which the invention may be practiced. In this regard, directional terminology, such as "top," "bottom," "front," "back," etc., is used with reference to the orientation of the Figure(s) being described. The components of the present invention can be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the present invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Similarly, the terms "facing," "faces" and variations thereof herein are used broadly and encompass direct and indirect facing, and "adjacent to" and variations thereof herein are used broadly and encompass directly and indirectly "adjacent to". Therefore, the description of "A" component facing "B" component herein may contain the situations that "A" component directly faces "B" component or one or more additional components are between "A" component and "B" component. Also, the description of "A" component "adjacent to" "B" component herein may contain the situations that "A" component is directly "adjacent to" "B" component or one or more additional components are between "A" component and "B" component. Accordingly, the drawings and descriptions will be regarded as illustrative in nature and not as restrictive.

Figure 2A:
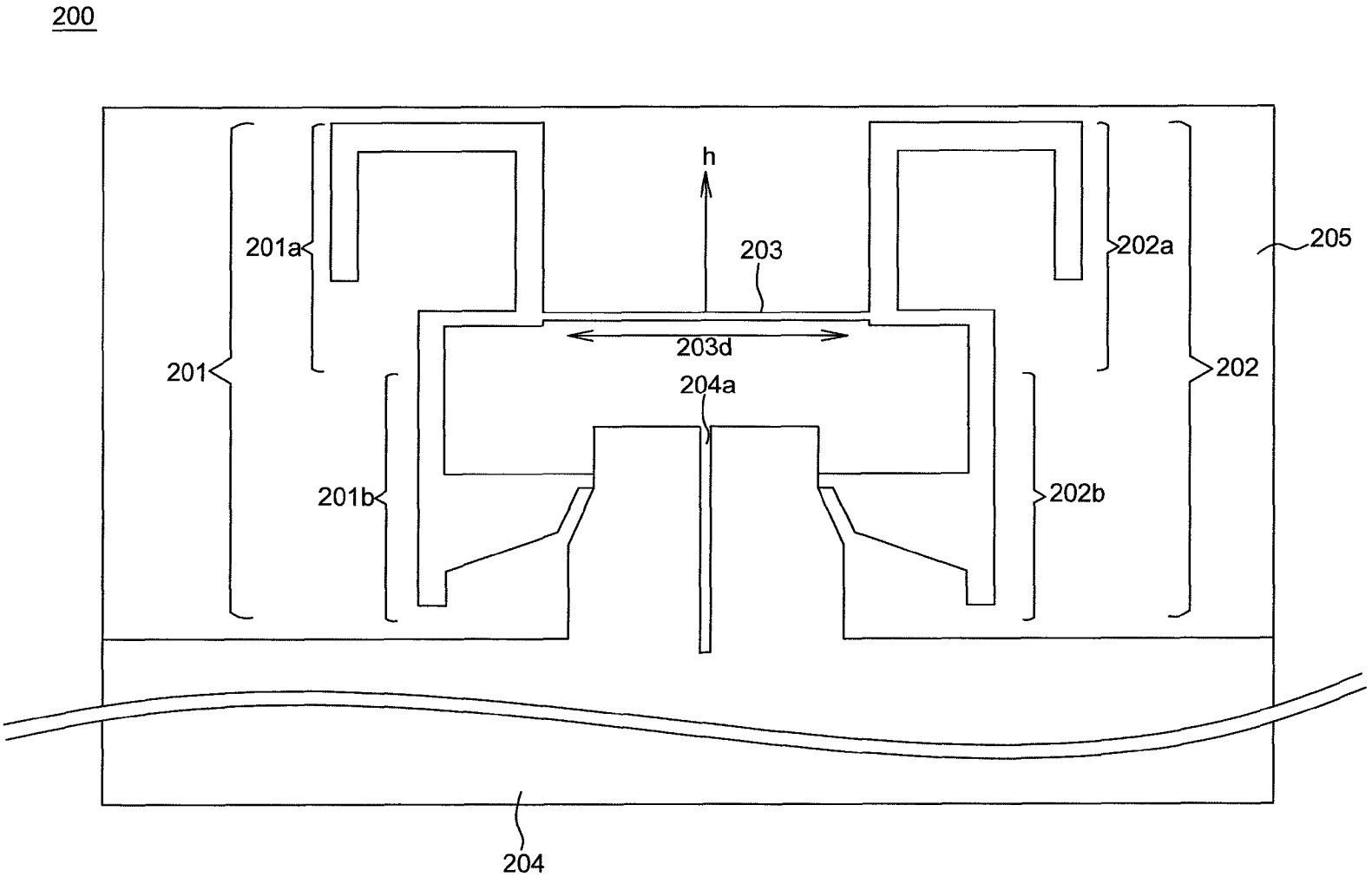
FIG. 2A shows a schematic diagram of an antenna set according to an embodiment of the invention.

FIG. 2A shows a schematic diagram of a dual-band antenna set for a multiple entry/exit system according to an embodiment of the invention. As illustrated in FIG. 2A, the antenna set 200 includes a first antenna 201, a second antenna 202, a neutralized line 203, a reference ground 204, and a substrate 205. Note in the description as set forth below and in the claims, the term "low frequency" includes, but is not limited to, frequency values of 2.4 GzHz and 2.5 GHz, and the term "high frequency" includes, but is not limited to, a frequency value of 5 GHz. That is, these frequency values are shown merely for exemplified purposes.

The first antenna 201 includes a first low frequency antenna 201*a* and a first high frequency antenna 201*b*. The first low frequency antenna 201*a* provides a first low frequency resonant path L1, and the first high frequency antenna 201*b* provide a high frequency resonant path H1, where the high frequency resonant path H1 is shorter compared with the first low frequency resonant path L1.

The second antenna 202 includes a second low frequency antenna 202*a* and a second high frequency antenna 202*b*. The second low frequency antenna 202*a* provides a second low frequency resonant path L2, and the second high frequency antenna 202*b* provides a second high frequency resonant path H2, where the high frequency resonant path H2 is shorter compared with the first low frequency resonant path L2.

In one embodiment, the low frequency resonant paths L1 and L2 correspond to a first frequency band, the high frequency resonant paths H1 and H2 correspond to a second frequency band, and the low frequency resonant paths L1 and L2 do not overlap the high frequency resonant paths H1 and H2.

In one embodiment, the first antenna 201 and the second antenna 202 are the same in structure and characteristic.

The neutralized line 203 is coupled between the first low frequency antenna 201*a* and the second low frequency antenna 202*a* to form a connection path 203*d*. The connection path 203*d* is only coupled to the first low frequency resonant path L1 and the second low frequency resonant path L2 but not coupled to the first high frequency resonant path H1 and the second high frequency resonant path H2. That is, the connection path 203*d* is separate from the high frequency resonant paths H1 and H2. Therefore, a coupling current caused by mutual induction of the first low frequency antenna 201*a* and the second low frequency antenna 202*a* may flow through the connection path 203*d* formed by the neutralized line 203. Under the circumstance, the phase and amplitude of a split current and a return current of the first low frequency antenna 201*a* or the second low frequency antenna 202*a* can be adjusted to reduce the coupling current, therefore relieving mutual coupling effects between the first low frequency antenna 201*a* and the second low frequency antenna 202*a* without influencing the high frequency resonant paths H1 and H2.

A printed circuit board on the substrate 205 includes a reference ground 204. The reference ground 204 is coupled to the first antenna 201 and the second antenna 202 and has a slot 204*a*.

Figure 2B:
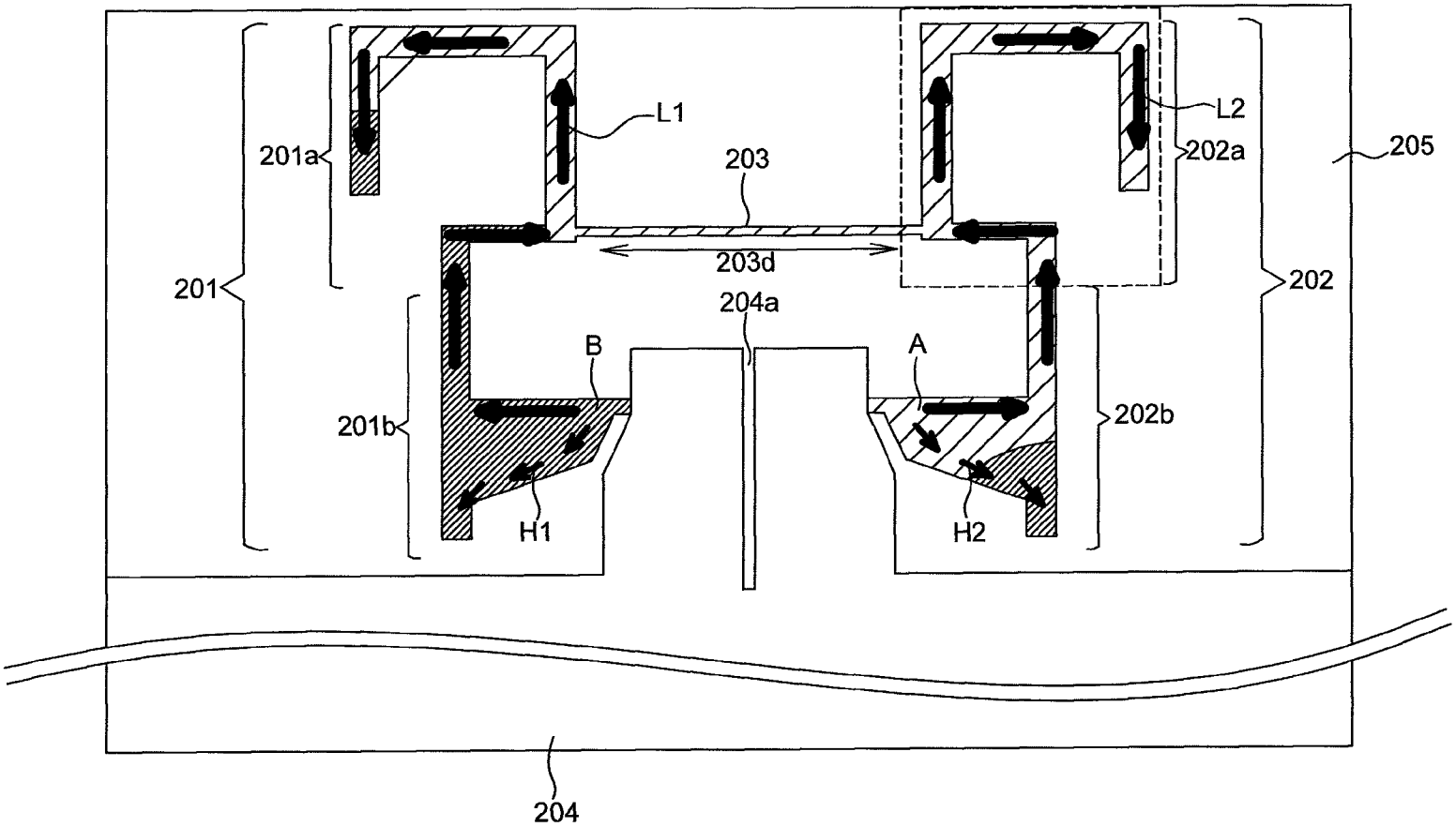
FIG. 2B presents simulated electric fields formed in an antenna set according to an embodiment of the invention.

FIG. 2B presents simulated electric fields formed in the dual-band antenna according to an embodiment of the invention. Assume the right-side second antenna 202 serves as an excitation source to transmit and receive signals and is excited at its feed point A, the neutralized line 203 may be used to neutralize an induced electric field formed in the left-side first antenna 201 through the connection path 203*d* to decrease the induction energy at a feed point B of the first antenna 201 induced by the second antenna 202 (excitation source) and thus enhance the isolation between the first antenna 201 and the second antenna 202.

In one embodiment, a distance between the first antenna 201 and the second antenna 202 is smaller than a quarter of a wavelength at a frequency of interest.

Figure 1:
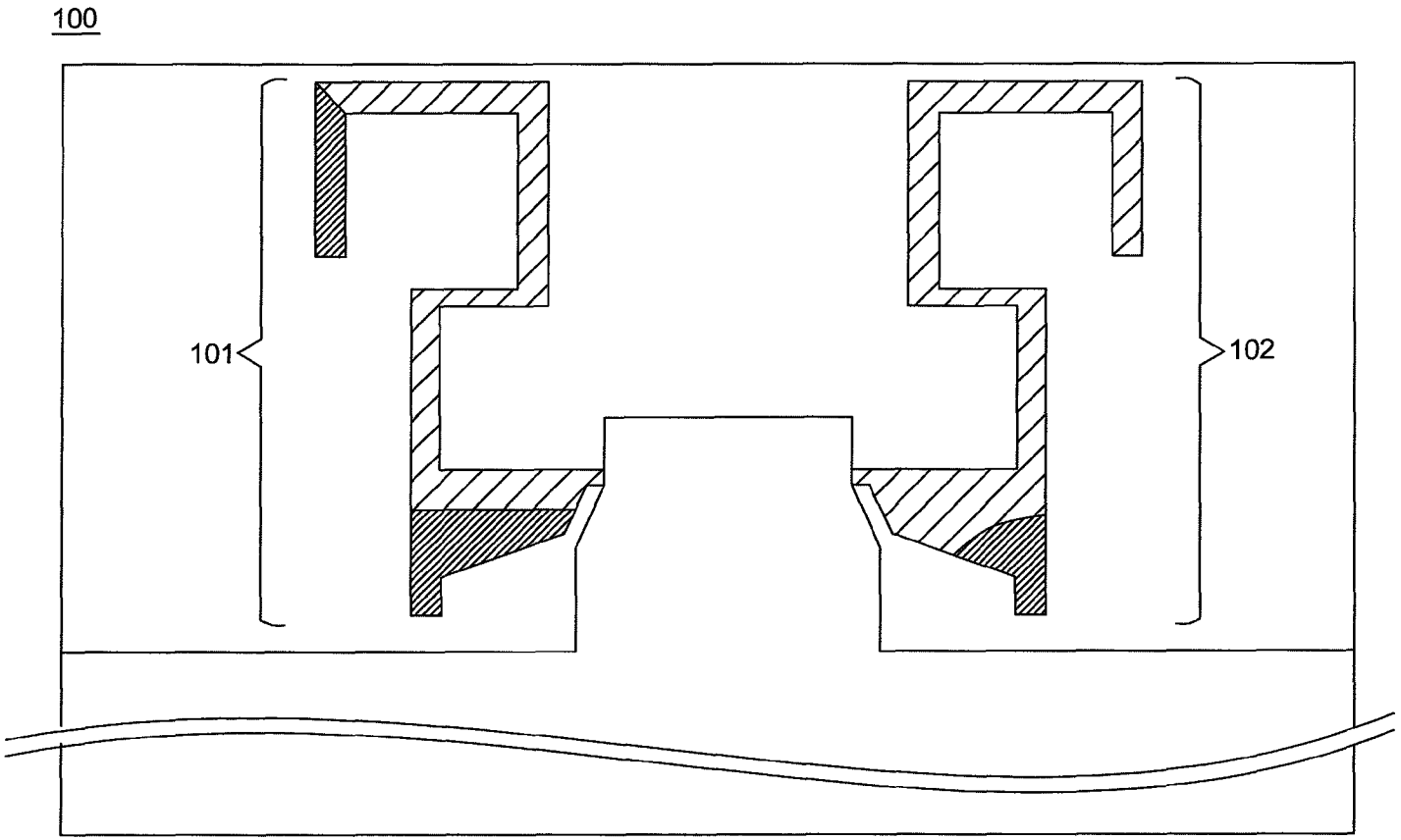
FIG. 1 (Prior Art)
FIG. 1 shows a schematic diagram illustrating a conventional dual-band antenna set.

In one embodiment, in the antenna set 200 (2.4/5 GHz), different communication bands do not share a common resonant path. For example, in case the neutralized line 203 is connected with the first antenna 201 and the second antenna 202 at low frequency (2.4 GHz) resonant paths L1 and L2, the neutralized line 203 is separate from the high frequency (5 GHz) resonant paths H1 and H2 and thus almost does not influence high frequency signals. Therefore, in this embodiment, the neutralized line 203 is coupled between the first low frequency antenna 201*a* and the second low frequency antenna 202*a*, and thus the connection path 203*d* is provided between the low frequency resonant paths L1 and L2 to enhance the antenna isolation for a low-frequency (2.4 GHz) communication band, without influencing the first high frequency antenna 201*b* and the second high frequency antenna 202*b* operating in a high-frequency (5 GHz) communication band. Further, the high frequency resonant paths H1 and H2 for the 5 GHz communication band are matched according to an interval of the reference ground 204 under the entire antenna structure. Accordingly, as shown in FIG. 2B, dense hatched areas in the first high frequency antenna 201*b* is larger as compared with FIG. 1, which indicates the electric field of the first high frequency antenna 201*b* is not influenced by an electric field induced by the right-side second antenna 202. Besides, dense hatched areas in the first low frequency antenna 201*a* is smaller as compared with FIG. 1, which indicates the antenna isolation between the first low frequency antenna 201*a* and the second low frequency antenna 202*a* is increased.

Figure 4A:
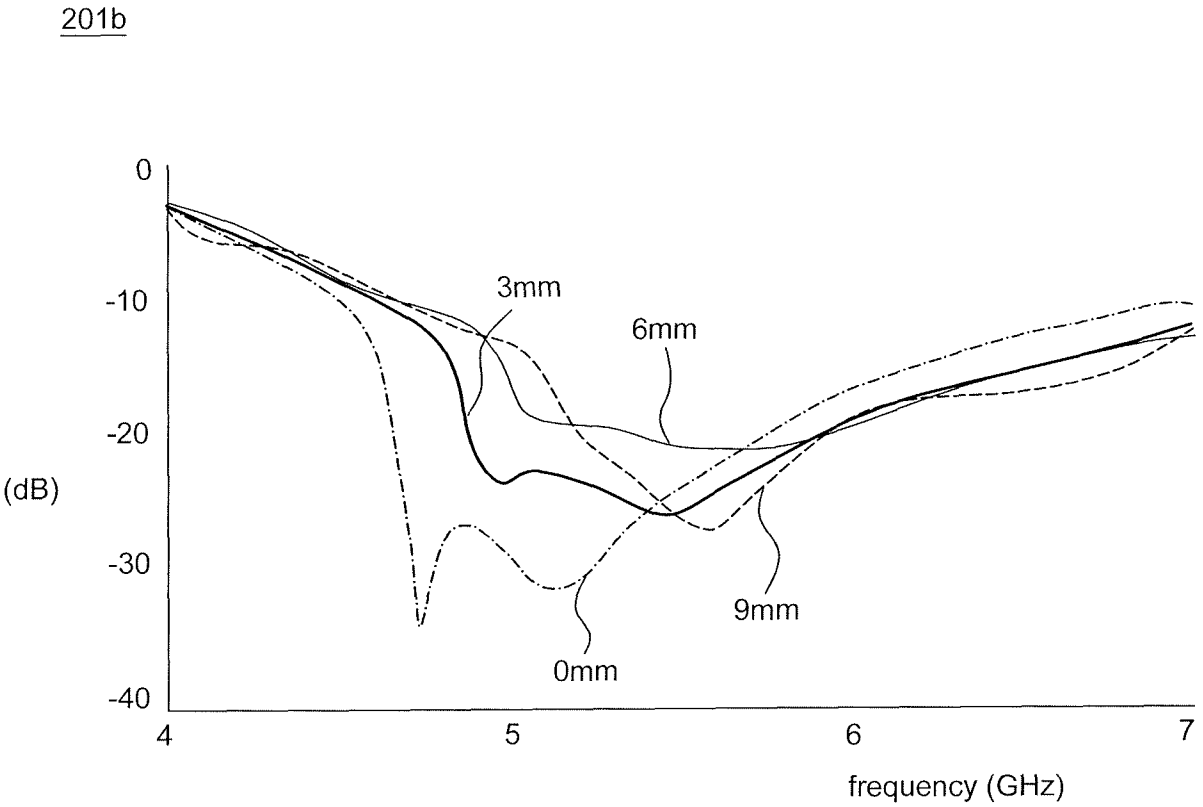
FIG. 4A presents simulation results of antenna return loss of an antenna set according to another embodiment.
Figure 4B:
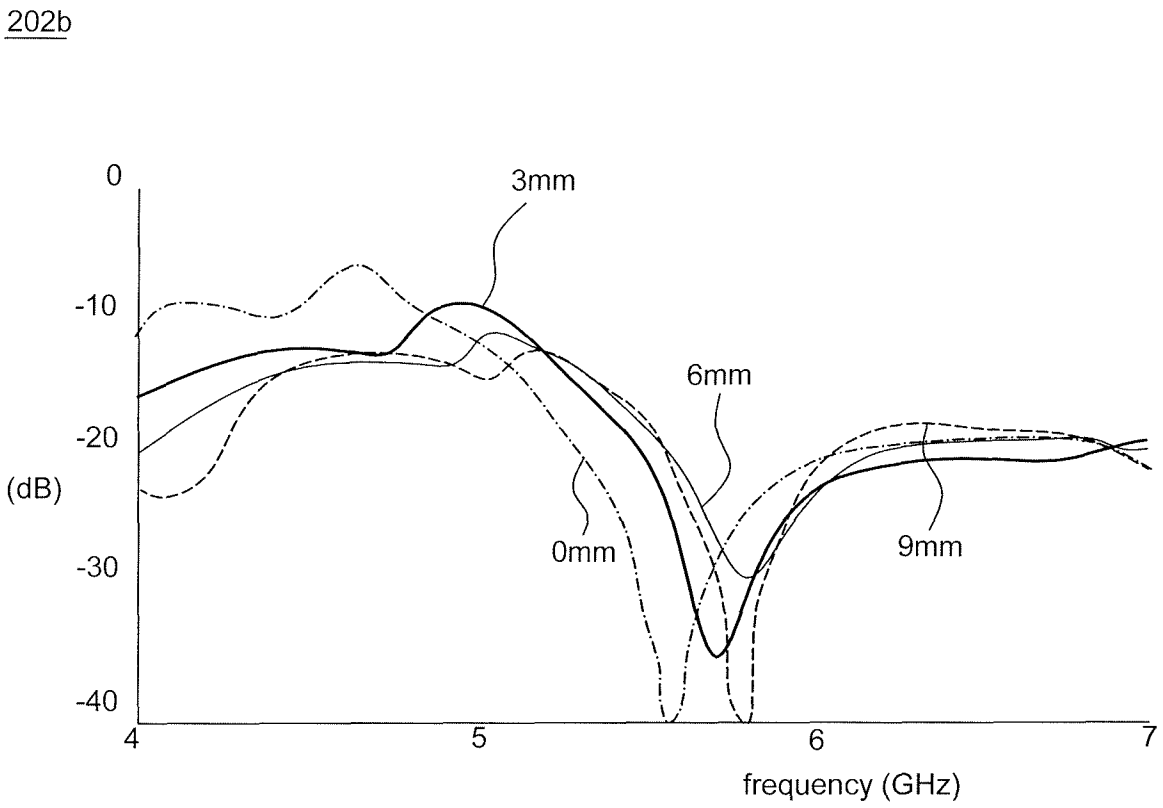
FIG. 4B presents simulation results of antenna isolation of an antenna set according to another embodiment.

Note the simulated electric fields shown in FIG. 2B are merely an example but not for limiting the invention. Besides, the neutralized line 203 can be moved in a direction indicated by an arrow h shown in FIG. 2A to be disposed in another position between the low frequency resonant paths L1 and L2 without notably affecting the return loss and antenna isolation in a high-frequency band. As illustrated in FIG. 4A, the neutralized line 203 moving a distance of 0 mm, 3 mm, 6 mm or 9 mm in the direction h does not show notably changes in the return loss for the 5 G frequency band of the first high frequency antenna 201*b*. Further, as shown in FIG. 4B, the neutralized line 203 moving a distance of 0 mm, 3 mm, 6 mm or 9 mm in the direction h may all achieve an isolation degree of larger than 20 dB for a high frequency band (5 GHz) of the second high frequency antenna 202*b* serving as an excitation source.

Figure 3:
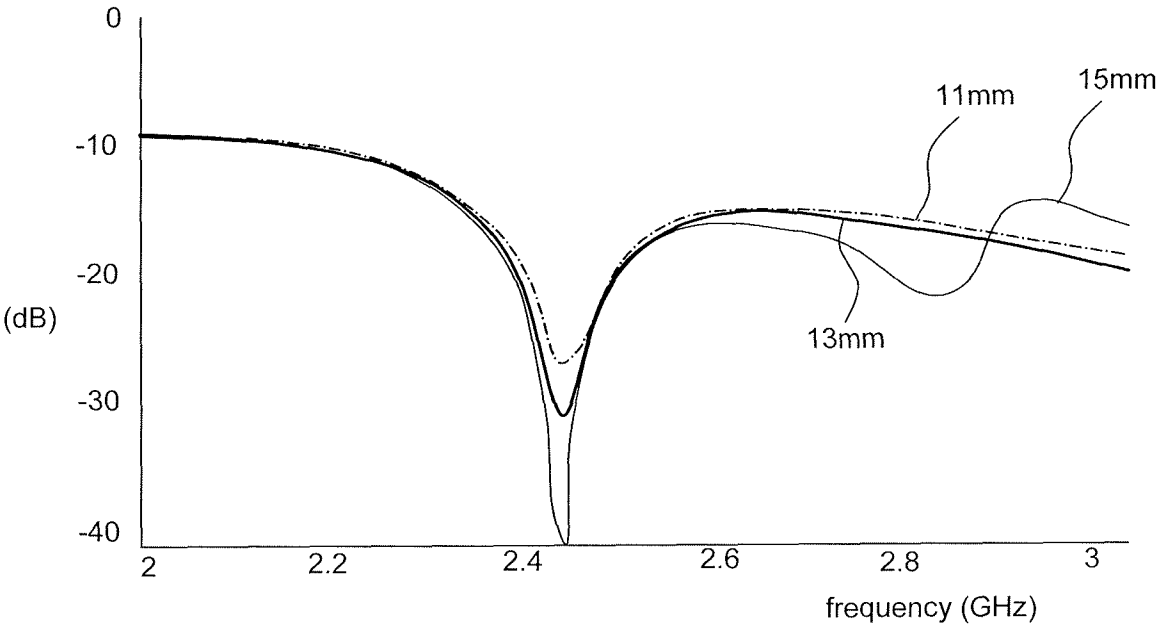
FIG. 3 presents simulation results of antenna isolation of an antenna set according to an embodiment.

Further, in one embodiment, the slot 204*a* is used to separate low-frequency induced electric fields, such as electric fields respectively induced by the first and the second low frequency antennas operating in a frequency band of 2.4 GHz. FIG. 3 presents simulation results of antenna isolation correspond to different lengths of the slot 204*a*. As illustrated in FIG. 3, when the slot 204*a* is adjusted to have a proper length (5-17 mm or smaller than 1/5λ), the isolation effects and bandwidth are both increased, and thus the slot 204*a* can be provided to reinforce the isolation effects achieved by solely using the neutralized line 203. As shown in FIG. 3, in case a length of the slot 204*a* is set as 11 mm, 13 mm or 15 mm, similar isolation effects of larger than 20 dB are achieved with respect to a frequency band of 2.4 G-2.5 G.

Typically, the propagation velocity V of electromagnetic waves satisfies: $V=\lambda\times f$, where λ denotes a wavelength and f denotes a frequency, and hence $\lambda=V/f$. Further, electromagnetic waves may propagate in different mediums at different velocities, and characteristics of each medium may be denoted as an equivalent permittivity $\epsilon_r$. Therefore, the propagation velocity V can be defined as: $V=C/\mathrm{sqrt}(\epsilon_r)$, where C is the speed of light in a vacuum ($\epsilon_r=1$). Typically, an equivalent permittivity $\epsilon_r$ of a fiber glass (FR4) substrate of a common antenna is equal to 3.8-4.4, and thus an equivalent permittivity $\epsilon_r$ of a medium between fiber glass FR4 and air is equal to 1-4.4. In one embodiment, the afore-mentioned wavelength is an equivalent wave length, and the wavelength $\lambda_r=C/(f\times\mathrm{sqrt}(\epsilon r))$, where C is the speed of light ($3\times10^8$ m/s), f is an operation frequency and $\epsilon_r$ is an equivalent permittivity. Certainly, the afore-mentioned data and materials are described only for exemplified purposes but not limiting the invention.

In one embodiment, the slot 204*a* is allowed to enhance the antenna isolation without the need of providing additional devices for further improving the antenna isolation. In that case, the slot 204*a* that occupies a small area is favorable to be applied to an antenna in a dongle having a small layout area.

Figure 5:
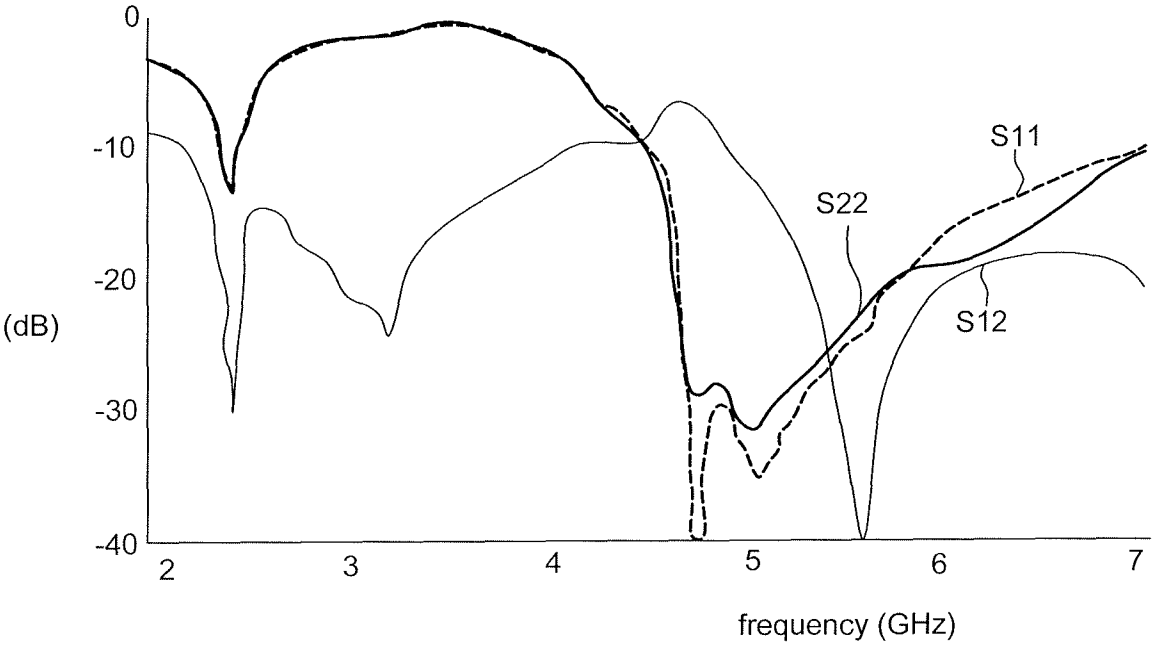
FIG. 5 presents simulation results of antenna isolation of an antenna set according to another embodiment.

In one embodiment, the neutralized line 203 may cooperate with the slot 204*a* to be applied to an antenna operating in frequency bands of 2.4-2.5 GHz and 5.15-5.85 GHz, and an isolation degree with respect to a frequency band of 2.4 GHz-2.48 GHz is increased to be larger than 20 dB, as shown in FIG. 5.

Figure 6:
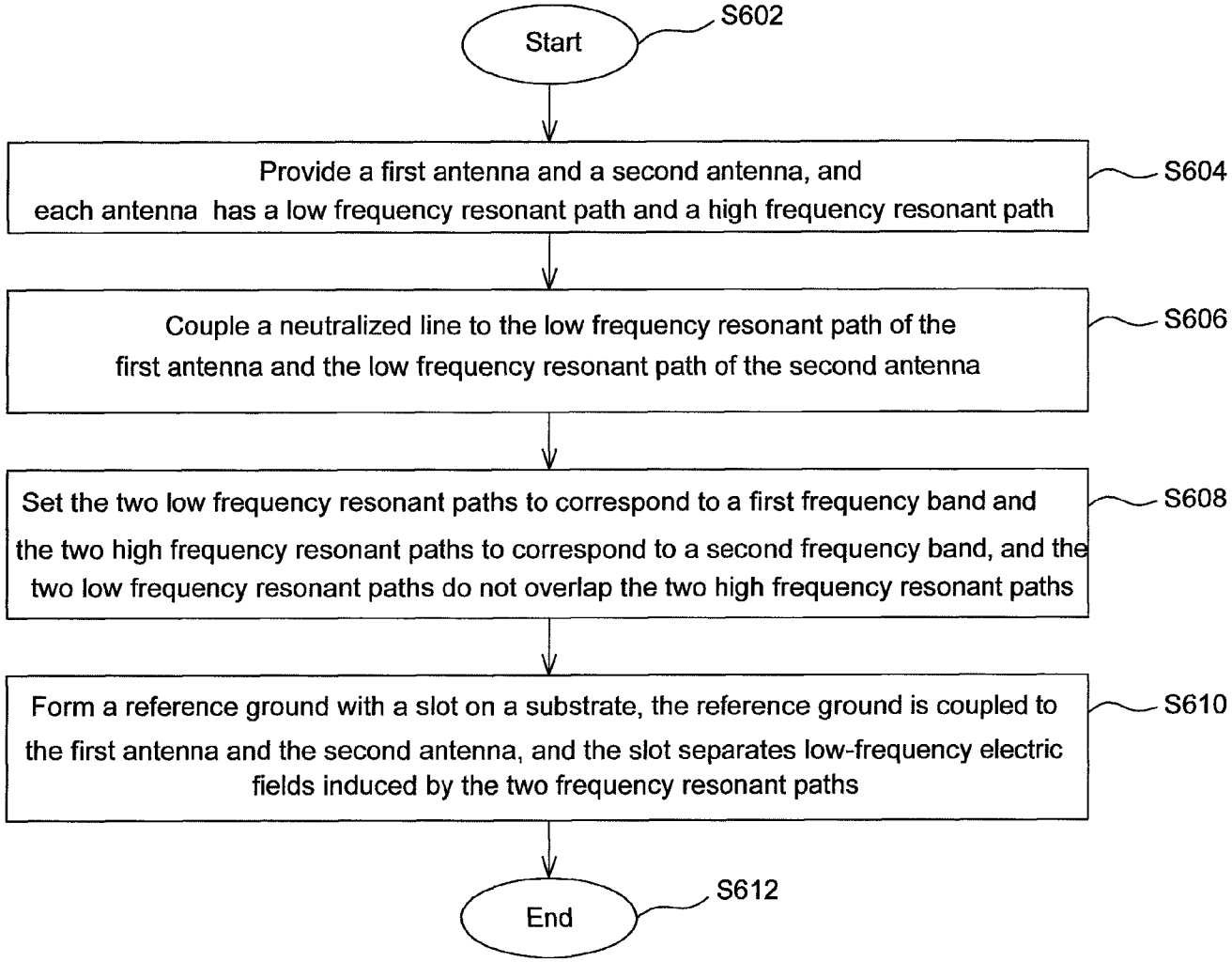
FIG. 6 shows a flow chart detailing an isolation enhancement method of an antenna set according to an embodiment of the invention.

FIG. 6 shows a flow chart detailing an isolation enhancement method of an antenna set according to an embodiment of the invention. The isolation enhancement method may include the following steps.

Step S602: Start.

Step S604: Provide a first antenna and a second antenna, where each of the first antenna and the second antenna has a low frequency resonant path and a high frequency resonant path.

Step S606: Couple a neutralized line to the low frequency resonant path of the first antenna and the low frequency resonant path of the second antenna.

Step S608: Set the two low frequency resonant paths to correspond to a first frequency band and the two high frequency resonant paths to correspond to a second frequency band. The two low frequency resonant paths do not overlap the two high frequency resonant paths. When the antenna set operates in the first frequency band, the neutralized line may adjust a current flowing through the two low frequency resonant paths to reduce coupling effects between the two low frequency resonant paths.

Step S610: Form a reference ground with a slot on a substrate. The reference ground is coupled to the first antenna and the second antenna, and the slot is allowed to separate low-frequency electric fields induced by the two frequency resonant paths.

Step S612 End.

According to the above embodiments, the neutralized line and/or the slot are used to enhance the antenna isolation to reduce signal interference with respect to the same frequency band and thus resolve problems of conventional designs.

The foregoing description of the preferred embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to particularly preferred exemplary embodiments of the invention does not imply a limitation on the invention, and no such limitation is to be inferred. The invention is limited only by the spirit and scope of the appended claims. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. An antenna set, comprising:

a first antenna and a second antenna, each of the first antenna and the second antenna having a low frequency resonant path and a high frequency resonant path; and a neutralized line couple to the low frequency resonant path of the first antenna and the low frequency resonant path of the second antenna, wherein the low frequency resonant path of the first antenna and the low frequency resonant path of the second antenna correspond to a first frequency band, the high frequency resonant path of the first antenna and the high frequency resonant path of the second antenna correspond to a second frequency band, the two low frequency resonant paths do not overlap the two high frequency resonant paths, and, when the antenna set operates in the first frequency band, the neutralized line adjusts a current flowing through the two low frequency resonant paths to reduce coupling effects between the two low frequency resonant paths.

2. The antenna set as claimed in claim 1, further comprising:

a substrate; and a reference ground formed on the substrate and coupled to the first antenna and the second antenna.

3. The antenna set as claimed in claim 2, wherein the reference ground has a slot and the slot is used to separate low-frequency electric fields induced by the two low frequency resonant paths.

4. The antenna set as claimed in claim 1, wherein the high frequency resonant path is shorter compared with the low frequency resonant path.

5. An antenna set, comprising:

a first antenna comprising a first low frequency antenna and a first high frequency antenna, the first low frequency antenna having a first low frequency resonant path, and the first high frequency antenna having a first high frequency resonant path;

a second antenna comprising a second low frequency antenna and a second high frequency antenna, the second low frequency antenna having a second low frequency resonant path, and the second high frequency antenna having a second high frequency resonant path; and a neutralized line coupled to the first low frequency antenna and the second low frequency antenna to form a connection path, wherein the connection path is coupled to the first low frequency resonant path and the second low frequency resonant path to divide a current flowing through the first low frequency resonant path and the second low frequency resonant path and thus reduce coupling effects between the first low frequency antenna and the second low frequency antenna.

6. The antenna set as claimed in claim 5, further comprising:

a substrate; and a reference ground formed on the substrate and coupled to the first antenna and the second antenna.

7. The antenna set as claimed in claim 6, wherein the reference ground has a slot and the slot is used to separate low-frequency electric fields induced by the first low frequency resonant path and the second low frequency resonant path.

8. The antenna set as claimed in claim 5, wherein the first and the second high frequency resonant paths are shorter compared with the first and the second low frequency resonant paths.

9. The antenna set as claimed in claim 5, wherein the neutralized line is coupled to the first low frequency resonant path and the second low frequency resonant path, and the first and the second low frequency resonant paths do not overlap the first and the second high frequency resonant paths.

10. The antenna set as claimed in claim 5, wherein an isolation degree and a bandwidth of the first low frequency antenna and the second low frequency antenna reach a predetermined value when a length of the slot is smaller than $1/5\lambda$.

11. An isolation enhancement method of an antenna set, comprising the following steps:

providing a first antenna and a second antenna, wherein each of the first antenna and the second antenna has a low frequency resonant path and a high frequency resonant path;

coupling a neutralized line to the low frequency resonant path of the first antenna and the low frequency resonant path of the second antenna; and setting the two low frequency resonant paths to correspond to a first frequency band and the two high frequency resonant paths to correspond to a second frequency band, wherein the two low frequency resonant paths do not overlap the two high frequency resonant paths, and, when the antenna set operates in the first frequency band, the neutralized line adjusts a current flowing through the two low frequency resonant paths to reduce coupling effects between the two low frequency resonant paths.

12. The isolation enhancement method as claimed in claim 11, further comprising:

forming a reference ground with a slot on a substrate, wherein the reference ground is coupled to the first antenna and the second antenna, and the slot separates low-frequency electric fields induced by the two frequency resonant paths.

* * * * *